US008127891B1

(12) United States Patent
Gudinas, Jr.

(10) Patent No.: US 8,127,891 B1
(45) Date of Patent: Mar. 6, 2012

(54) LADDER MOUNTED FOOT RINSING SYSTEM

(76) Inventor: Jerry S. Gudinas, Jr., Crestview, FL (US)

( * ) Notice: Subject to any disclaimer, the term of this patent is extended or adjusted under 35 U.S.C. 154(b) by 309 days.

(21) Appl. No.: 12/487,430

(22) Filed: Jun. 18, 2009

(51) Int. Cl.
*E06C 5/32* (2006.01)

(52) U.S. Cl. ..... 182/129

(58) Field of Classification Search ..... 182/129
See application file for complete search history.

(56) References Cited

U.S. PATENT DOCUMENTS

| | | | | | |
|---|---|---|---|---|---|
| 536,020 | A | * | 3/1895 | Ebert | 4/618 |
| 724,953 | A | * | 4/1903 | Schaller | 182/52 |
| 2,654,894 | A | * | 10/1953 | Van Dijck | 4/615 |
| 2,965,305 | A | * | 12/1960 | Glazer et al. | 239/195 |
| 3,072,131 | A | * | 1/1963 | Di Laurenzio | 134/123 |
| 3,090,465 | A | * | 5/1963 | Smith | 182/52 |
| 3,090,489 | A | * | 5/1963 | Smith | 210/167.12 |
| 3,401,707 | A | * | 9/1968 | Horwitz | 134/100.1 |
| 3,752,472 | A | * | 8/1973 | Snead | 482/35 |
| 3,925,830 | A | | 12/1975 | Delaney | |
| D243,019 | S | | 1/1977 | Confer | |
| 4,193,143 | A | | 3/1980 | De Carvalho Vianna | |
| 4,749,130 | A | * | 6/1988 | Utzinger | 239/543 |
| 4,961,535 | A | * | 10/1990 | Skibik | 239/289 |
| 5,173,972 | A | * | 12/1992 | Goodman | 4/494 |
| 5,205,306 | A | * | 4/1993 | Peterson | 134/104.2 |
| 5,326,337 | A | * | 7/1994 | Pardella | 482/36 |
| 5,367,720 | A | * | 11/1994 | Stephens et al. | 4/494 |
| 5,480,336 | A | * | 1/1996 | Blanchard | 446/89 |
| 5,862,625 | A | * | 1/1999 | Parker | 47/47 |
| 5,913,477 | A | * | 6/1999 | Dean | 239/289 |
| 6,367,584 | B1 | * | 4/2002 | Edwards | 182/93 |
| RE37,830 | E | * | 9/2002 | Chase | 118/680 |
| 6,618,870 | B2 | * | 9/2003 | Farias | 4/605 |
| 6,736,339 | B1 | | 5/2004 | Mayers | |
| 7,017,299 | B1 | * | 3/2006 | Speed et al. | 47/44 |
| 7,877,826 | B2 | * | 2/2011 | Franklin | 4/615 |
| 2010/0151952 | A1 | * | 6/2010 | King et al. | 472/136 |

* cited by examiner

*Primary Examiner* — Alvin Chin Shue
*Assistant Examiner* — Daniel Cahn

(57) ABSTRACT

A ladder mounted foot rinsing system includes a ladder that has a pair of legs and a plurality of rungs attached to the legs. A conduit apparatus comprises a pair of lateral tubes each has a top end and a bottom end. A plurality of horizontal tubes is attached to and extends between the lateral tubes. The horizontal tubes and the lateral tubes are fluidly coupled together. Each of the horizontal and lateral tubes has apertures extending therein. A water inlet is fluidly coupled to the conduit apparatus. The water inlet is fluidly couplable to a water supply to supply water to the conduit apparatus. Water supplied to conduit apparatus is ejected outwardly of the apertures. A plurality of couplers couples the conduit apparatus to the conduit apparatus to the ladder. Feet of a person placed on the rungs are cleaned by water is ejected by the apertures.

7 Claims, 4 Drawing Sheets

LADDER MOUNTED FOOT RINSING SYSTEM

BACKGROUND OF THE DISCLOSURE

Field of the Disclosure

The disclosure relates to foot rinsing devices and more particularly pertains to a new foot rinsing device for rinsing off a person's foot as they climb a ladder and before they enter a pool.

SUMMARY OF THE DISCLOSURE

An embodiment of the disclosure meets the needs presented above by generally comprising a ladder that has a pair of legs and a plurality of rungs extending between and is attached to the legs. A conduit apparatus comprises a pair of lateral tubes each has a top end and a bottom end. A plurality of horizontal tubes is attached to and extends between the lateral tubes. The horizontal tubes and the lateral tubes are fluidly coupled together. Each of the horizontal and lateral tubes has apertures extending therein. A water inlet is fluidly coupled to the conduit apparatus. The water inlet is fluidly couplable to a water supply to supply water to the conduit apparatus. Water supplied to conduit apparatus is ejected outwardly of the apertures. A plurality of couplers couples the conduit apparatus to the conduit apparatus to the ladder. Feet of a person placed on the rungs are cleaned by water is ejected by the apertures.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
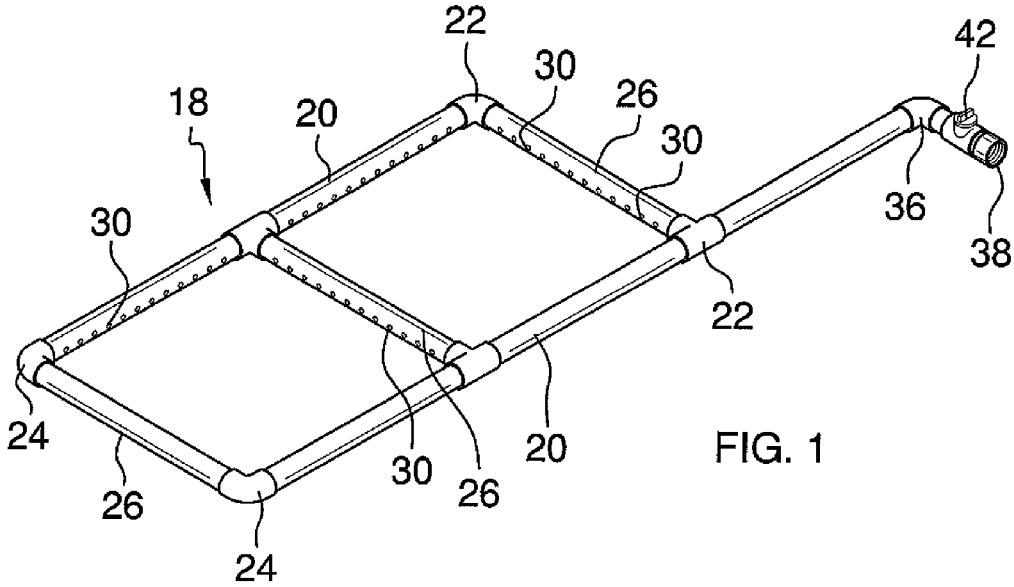
FIG. 1 is a bottom perspective view of a ladder mounted foot rinsing system according to an embodiment of the disclosure.
Figure 2:
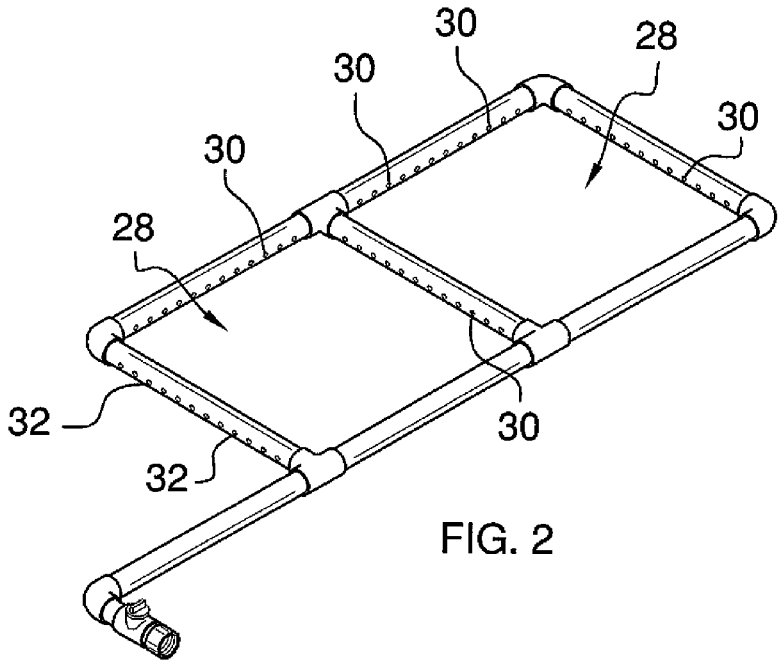
FIG. 2 is a top perspective view of an embodiment of the disclosure.

With reference now to the drawings, and in particular to FIGS. 1 through 6 thereof, a new foot rinsing device embodying the principles and concepts of an embodiment of the disclosure and generally designated by the reference numeral 10 will be described.

As best illustrated in FIGS. 1 through 6, the ladder mounted foot rinsing system 10 generally comprises a ladder 12 that has a pair of legs 14 and a plurality of rungs 16 extending between and is attached to the legs 14. The ladder 12 is conventional and will typically include a ladder mounted to a slide extending into a pool or mounted to the side of an above-ground pool.

Figure 3:
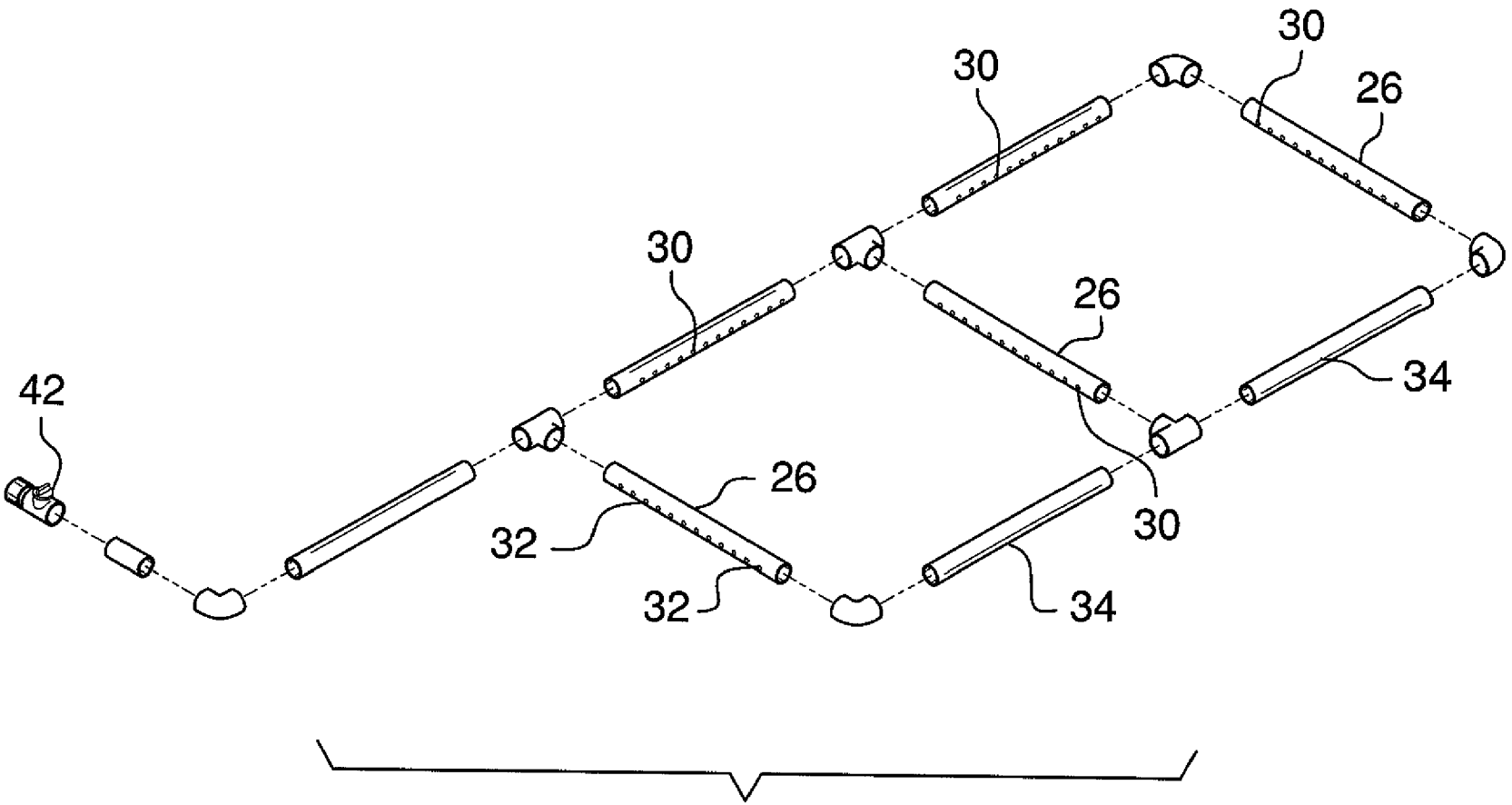
FIG. 3 is an expanded perspective view of an embodiment of the disclosure.
Figure 4:
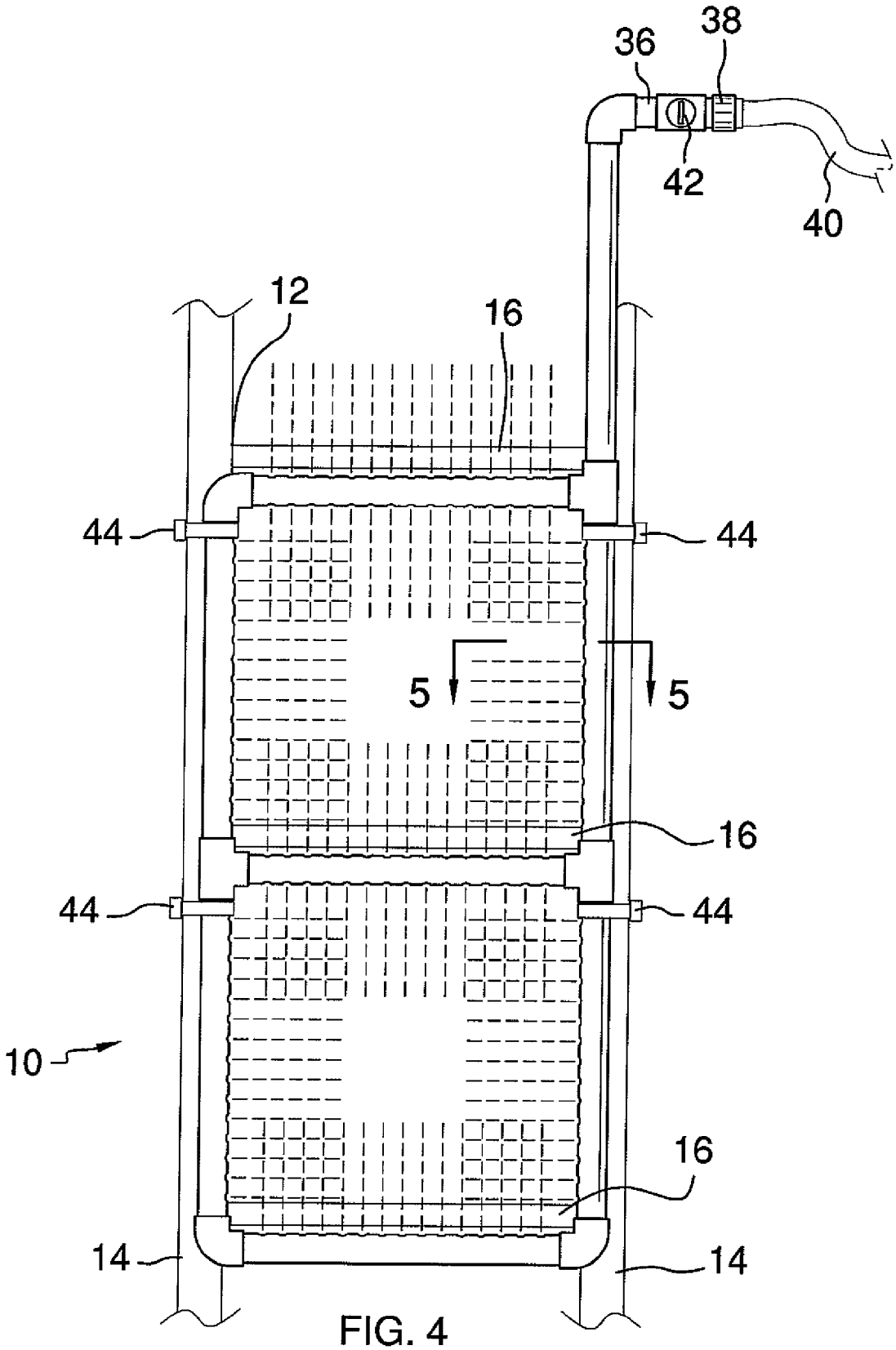
FIG. 4 is a front in-use view of an embodiment of the disclosure.
Figure 5:
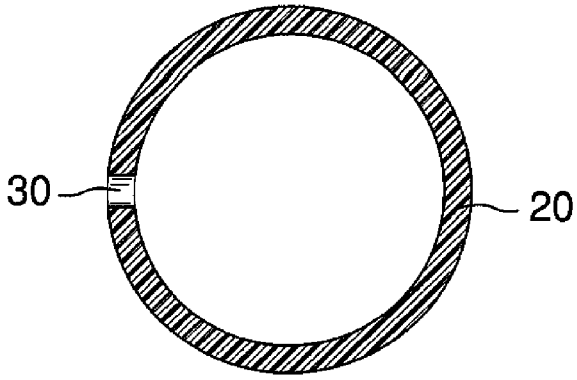
FIG. 5 is a cross-sectional view taken along line 5-5 of FIG. 4 of an embodiment of the disclosure.
Figure 6:
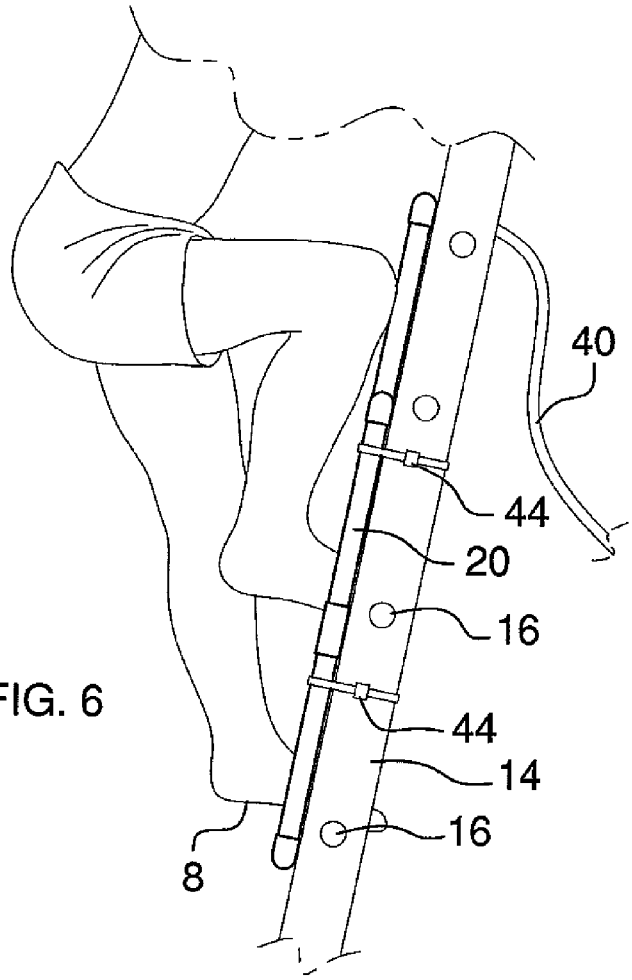
FIG. 6 is a side in-use view of an embodiment of the disclosure.

A conduit apparatus 18 is provided and includes a pair of lateral tubes 20 each having a top end 22 and a bottom end 24. A plurality of horizontal tubes 26 is attached to and extends between the lateral tubes 20. The horizontal tubes 26 and the lateral tubes 20 are fluidly coupled together. Pairs of adjacent ones of the horizontal tubes 26 and the lateral tubes 20 define rectangular frames bounding an interior space 28. Each of the horizontal 26 and lateral 20 tubes has apertures 30 extending therein. The apertures 30 are each directed toward an associated interior space 28 of the frames. The lateral tubes 20 are orientated parallel to each other. The horizontal tubes 26 are orientated parallel to each other and the horizontal tubes 26 are equally spaced from each other. The horizontal tubes 26 are spaced form each other a distance approximately equal to a distance between the rungs 16. The top ends 22 of the lateral tubes 20 are horizontally aligned with each other and the bottom ends 24 of the lateral tubes 20 are horizontally aligned with each other. The lateral tubes 20 are spaced from each other a distance approximately equal to a distance between the legs 14. As shown in FIG. 3, the lateral tubes 20 may be comprised of tube sections 34. Secondary apertures 32 may be included, particularly on an uppermost one of the horizontal tubes 26 positioned adjacent to the top ends 22 which are directly upwardly from the conduit apparatus 18 and away from the interior spaces 28.

A water inlet 36 is fluidly coupled to the conduit apparatus 18. The water inlet 36 is fluidly couplable to a water supply to supply water to the conduit apparatus. Water supplied to conduit apparatus 18 is ejected outwardly of the apertures 30. The water inlet 36 may include a threaded female coupler 38 couplable to a conventional male end of a garden hose 40. A valve 42 is mounted on the water inlet 36 and is positionable in a closed position to prevent water from entering the conduit apparatus 18 or in an open position to allow water to flow into the conduit apparatus 18.

A plurality of couplers 44 couples the conduit apparatus 18 to the conduit apparatus to the ladder 12. Each of the rungs 16 has one of the horizontal tubes 26 positioned adjacent thereto and associated therewith. The horizontal tubes 26 are positioned below and within 3 inches of an associated one of the rungs 16. Each of the lateral tubes 20 is aligned with one of said legs 14 of said ladder 12. The couplers 44 may include any conventional form of clamp, strapping or fastener.

In use, when a person climbs the ladder 12, the feet of the person are cleansed as they place their feet on the rungs 16 positioned in the interior space 28 or above the uppermost one of the horizontal tubes 26 if the secondary apertures 32 are utilized. The ladder 12 will typically be a ladder for a pool slide or a ladder for entering an above ground pool. The system 10 will clean debris and soil from the person's feet 8 to prevent the debris and soil from being carried into the pool by the feet 8.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A foot rinsing system to rinse soil from a person's foot, said system including:

a ladder having a pair of legs and a plurality of rungs extending between and being attached to said legs;

a conduit apparatus comprising;

a pair of lateral tubes each having a top end and a bottom end;

a plurality of horizontal tubes being attached to and extending between said lateral tubes, said horizontal tubes and said lateral tubes being fluidly coupled together, each of said horizontal and lateral tubes having apertures extending therein;

a plurality of rectangular frames being formed by said pair of lateral tubes and said plurality of horizontal tubes wherein each rectangular frame includes two adjacent ones of said horizontal tubes and said pair of lateral tubes each rectangular frame bounding an interior space, each of said apertures being directed toward said associated interior space of said rectangular frames, a plane extending through each of said horizontal and vertical tubes, said apertures being directed into said plane;

a water inlet being fluidly coupled to said conduit apparatus, said water inlet being fluidly couplable to a water supply to supply water to said conduit apparatus, wherein said conduit apparatus is configured to eject water outwardly of said apertures when the water is supplied to said conduit apparatus, a plurality of couplers coupling said conduit apparatus to said ladder; and wherein said system is configured to clean feet of a person placed on said rungs by water being ejected by said apertures.

2. The system according to claim 1, wherein said lateral tubes are orientated parallel to each other and said horizontal tubes are orientated parallel to each other, each of said horizontal tubes being equally spaced from adjacent ones of said horizontal tubes.

3. The system according to claim 1, wherein said horizontal tubes are spaced form each other a distance approximately equal to a distance between said rungs, said lateral tubes being spaced from each other a distance approximately equal to a distance between said legs.

4. The system according to claim 3, wherein each of said rungs has one of said horizontal tubes being positioned adjacent thereto and associated therewith.

5. The system according to claim 4, wherein said horizontal tubes are positioned below and within 3 inches of an associated one of said rungs.

6. The system according to claim 1, further including a valve being mounted on said water inlet, said valve being positionable in a closed position to prevent water from entering said conduit apparatus or in an open position to allow water to flow into said conduit apparatus.

7. A foot rinsing system to rinse soil from a person's foot, said system including:

a ladder having a pair of legs and a plurality of rungs extending between and being attached to said legs;

a conduit apparatus comprising;

a pair of lateral tubes each having a top end and a bottom end;

a plurality of horizontal tubes being attached to and extending between said lateral tubes, said horizontal tubes and said lateral tubes being fluidly coupled together, a plurality of rectangular frames are formed by said pair of lateral tubes and said plurality of horizontal tubes wherein each rectangular frame includes two adjacent ones of said horizontal tubes and said pair of lateral tubes, each rectangular frame bounding an interior space, each of said horizontal and lateral tubes having apertures extending therein, each of said apertures being directed toward an said associated interior space of said rectangular frames, said lateral tubes being orientated parallel to each other, said horizontal tubes being orientated parallel to each other, each of said horizontal tubes being equally spaced from adjacent ones of said horizontal tubes, said horizontal tubes being spaced from each other a distance approximately equal to a distance between said rungs, said top ends of said lateral tubes being horizontally aligned with each other and said bottom ends of said lateral tubes being horizontally aligned with each other, said lateral tubes being spaced from each other a distance approximately equal to a distance between said legs, a plane extending through each of said horizontal and vertical tubes, said apertures being directed into said plane;

a water inlet being fluidly coupled to said conduit apparatus, said water inlet being fluidly couplable to a water supply to supply water to said conduit apparatus, wherein said conduit apparatus is configured to eject water outwardly of said apertures when the water is supplied to said conduit apparatus;

a plurality of couplers coupling said conduit apparatus to said ladder, each of said rungs having one of said horizontal tubes being positioned adjacent thereto and associated therewith, said horizontal tubes being positioned below and within 3 inches of an associated one of said rungs;

a valve being mounted on said water inlet, said valve being positionable in a closed position to prevent water from entering said conduit apparatus or in an open position to allow water to flow into said conduit apparatus; and wherein said system is configured to clean feet of a person placed on said rungs by water being ejected by said apertures.

* * * * *